US009055369B2

(12) United States Patent
Yang

(10) Patent No.: US 9,055,369 B2
(45) Date of Patent: Jun. 9, 2015

(54) EARPHONE

(75) Inventor: Bill Yang, Taipei (TW)

(73) Assignee: Cotron Corporation, Taipei (TW)

( * ) Notice: Subject to any disclaimer, the term of this patent is extended or adjusted under 35 U.S.C. 154(b) by 467 days.

(21) Appl. No.: 13/025,182

(22) Filed: Feb. 11, 2011

(65) Prior Publication Data

US 2012/0087532 A1 Apr. 12, 2012

(30) Foreign Application Priority Data

Oct. 6, 2010 (TW) ..... 99134100 A

(51) Int. Cl.
*H04R 1/10* (2006.01)
*H04R 1/24* (2006.01)
*H04R 1/26* (2006.01)

(52) U.S. Cl.
CPC .. *H04R 1/26* (2013.01); *H04R 1/24* (2013.01); *H04R 1/10* (2013.01); *H04R 1/1033* (2013.01)

(58) Field of Classification Search
USPC ..... 381/74, 182, 186, 371, 380, 382
See application file for complete search history.

(56) References Cited

U.S. PATENT DOCUMENTS

| | | | | |
|---|---|---|---|---|
| 3,943,304 | A * | 3/1976 | Piribauer | 381/182 |
| 2004/0218775 | A1* | 11/2004 | Huang | 381/182 |
| 2008/0317255 | A1* | 12/2008 | Cozens et al. | 381/182 |
| 2009/0116676 | A1* | 5/2009 | Welsh et al. | 381/380 |

* cited by examiner

*Primary Examiner* — Jesse Elbin
(74) *Attorney, Agent, or Firm* — Jianq Chyun IP Office

(57) ABSTRACT

An earphone including a housing, a bracket, a first speaker unit and a second speaker unit is provided. The bracket disposed inside the housing includes a front plate, a first tube portion, a second tube portion and at least one connecting portion. The first tube portion is connected to the front plate. The second tube portion is separated from the first tube portion. The first tube portion is between the front plate and the second tube portion. The connecting portion connects the first tube portion and the second tube portion. The front plate has a central hole and surrounding holes. The second accommodating space is communicated to a main audio-output path of the housing through the surrounding holes. The first speaker unit is disposed in a first accommodating space of the first tube portion. The second speaker unit is disposed in a second accommodating space of the second tube portion.

4 Claims, 3 Drawing Sheets

EARPHONE

CROSS-REFERENCE TO RELATED APPLICATION

This application claims the priority benefits of Taiwan application serial no. 99134100, filed on Oct. 6, 2010. The entirety of the above-mentioned patent applications is hereby incorporated by reference herein and made a part of specification.

BACKGROUND OF THE INVENTION

1. Field of the Invention

The present invention relates to an earphone, and more particularly, to the one that has two speaker units.

2. Description of Related Art

With the rapid progress in science and technology, all electronic products have been developed towards light, handy and miniaturized designs. People may use miniaturized electronic products, such as radios or walkmans, anytime and anywhere. Moreover, the personal digital product, such as common MP3 walkmans, cell phones, personal digital assistants (PDAs) or notebooks, has increasingly become popular, and thus being indispensable in the daily life. In addition, the cell phone integrated with functions of both radio and MP3 has immerged.

For each of those aforementioned electronic products, in order to allow a user to listen to the audio information provided by the electronic product without disturbing the other people around, an earphone has become a necessary accessory to the electronic product. Moreover, the earphone also provides a listener better audio transmission so that the listener can clearly hear and understand content of the audio information. In contrast to unclear audio transmission through the air, especially when the listener is moving, for example like doing exercises, driving, intensely moving around or being in a noisy environment, the audio transmission of the earphone still would not be affected.

The conventional earphone generally uses a single speaker unit. However, the output audio frequency of each speaker unit has specific range, and uniform performance in all frequency can not be achieved.

SUMMARY OF THE INVENTION

Accordingly, the present invention is directed to an earphone, which solves the problem of narrow range of output audio frequency of single speaker unit.

An earphone of the present invention includes a housing, a bracket, a first speaker unit and a second speaker unit. The housing includes a front housing and a rear housing. The front housing is assembled to the rear housing. The front housing has a main audio-output path. The bracket is disposed inside the housing. The bracket disposed includes a front plate, a first tube portion, a second tube portion and at least one connecting portion. The first tube portion is connected to the front plate and has a first accommodating space. The second tube portion is separated from the first tube portion and has a second accommodating space. The first tube portion is between the front plate and the second tube portion. The connecting portion connects the first tube portion and the second tube portion. The front plate has a central hole and a plurality of surrounding holes around the central hole. The first accommodating space is connected to the main audio-output path via the central hole. The second accommodating space is communicated to the main audio-output path through the surrounding holes. The first speaker unit is disposed in the first accommodating space. The second speaker unit is disposed in the second accommodating space.

According to one embodiment of the present invention, an inner wall of the second tube portion has a wire trench.

According to one embodiment of the present invention, the housing has a wire hole.

According to an embodiment of the present invention, the earphone further comprises a plurality of conductive wires. The first speaker unit has two first input terminals and two first output terminals. Each of the first input terminals is electrically connected to one of the first output terminals. The second speaker unit has two second input terminals, two second output terminals and two connection terminals. Each of the second input terminals is electrically connected to one of the second output terminals and one of the connection terminals. Each of the second input terminals is electrically connected to an external audio source via one of the conductive wires. Each of the second output terminals is electrically connected to a second coil of the second speaker unit via one of the conductive wires. Each of the connection terminals is electrically connected to one of the first input terminals via one of the conductive wires. Each of the first output terminals is electrically connected to a first coil of the first speaker unit via one of the conductive wires.

According to an embodiment of the present invention, an output audio frequency of the first speaker unit is higher than an output audio frequency of the second speaker unit.

In view of the above, the range of the entire output audio frequency produced by two speaker units of the earphone of the present invention is broader, and a uniform frequency response in all frequency can be achieved.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
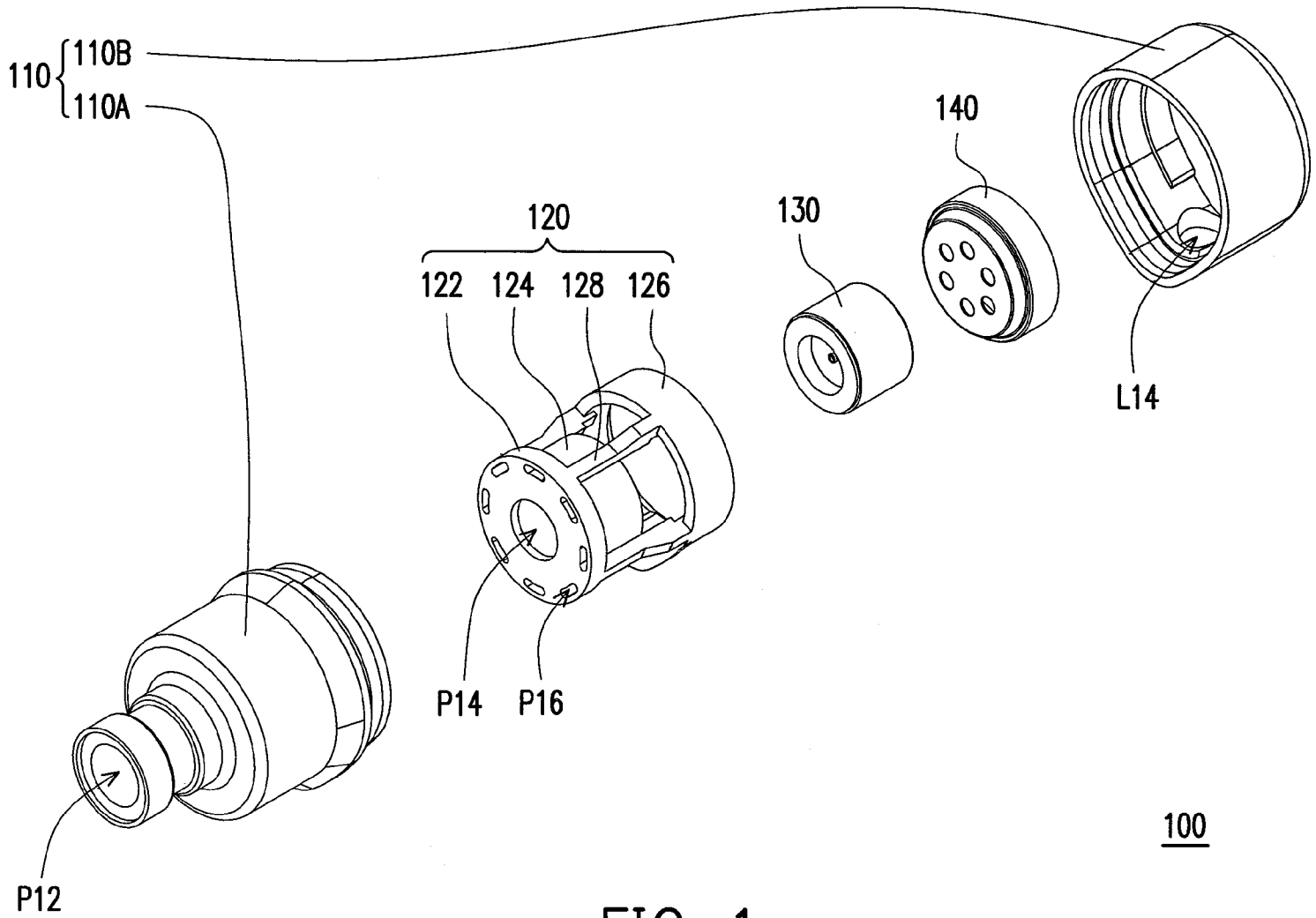
FIGS. 1 to 2 illustrate two views of an earphone according to one embodiment of the present invention.
Figure 2:
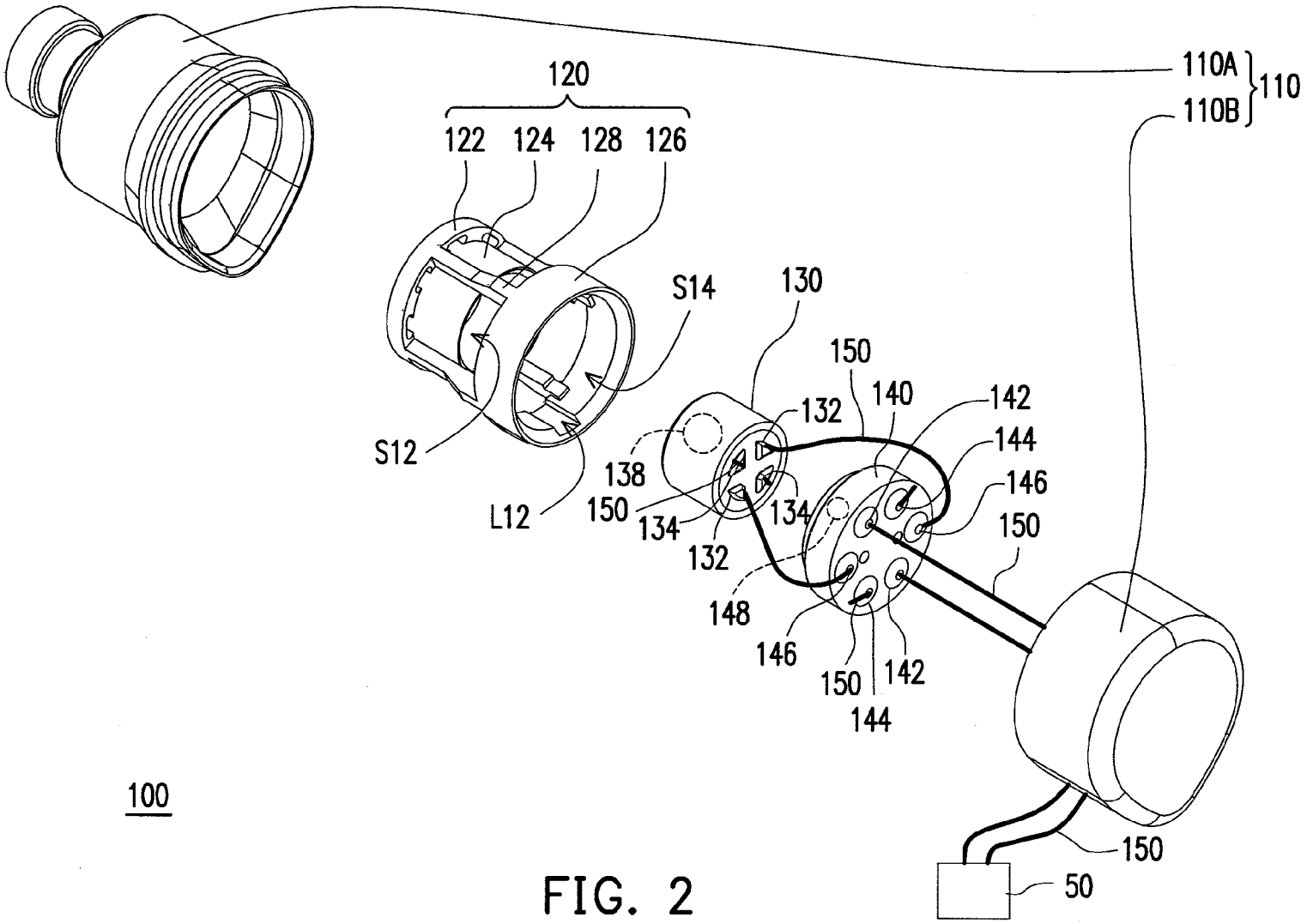

FIGS. 1 to 2 illustrate two views of an earphone according to one embodiment of the present invention. Referring to FIGS. 1 and 2, an earphone 100 of the present embodiment includes a housing 110, a bracket 120, a first speaker unit 130 and a second speaker unit 140. The bracket 120 is disposed inside the housing 110 and has a first accommodating space S12 and a second accommodating space S14.

Figure 3:
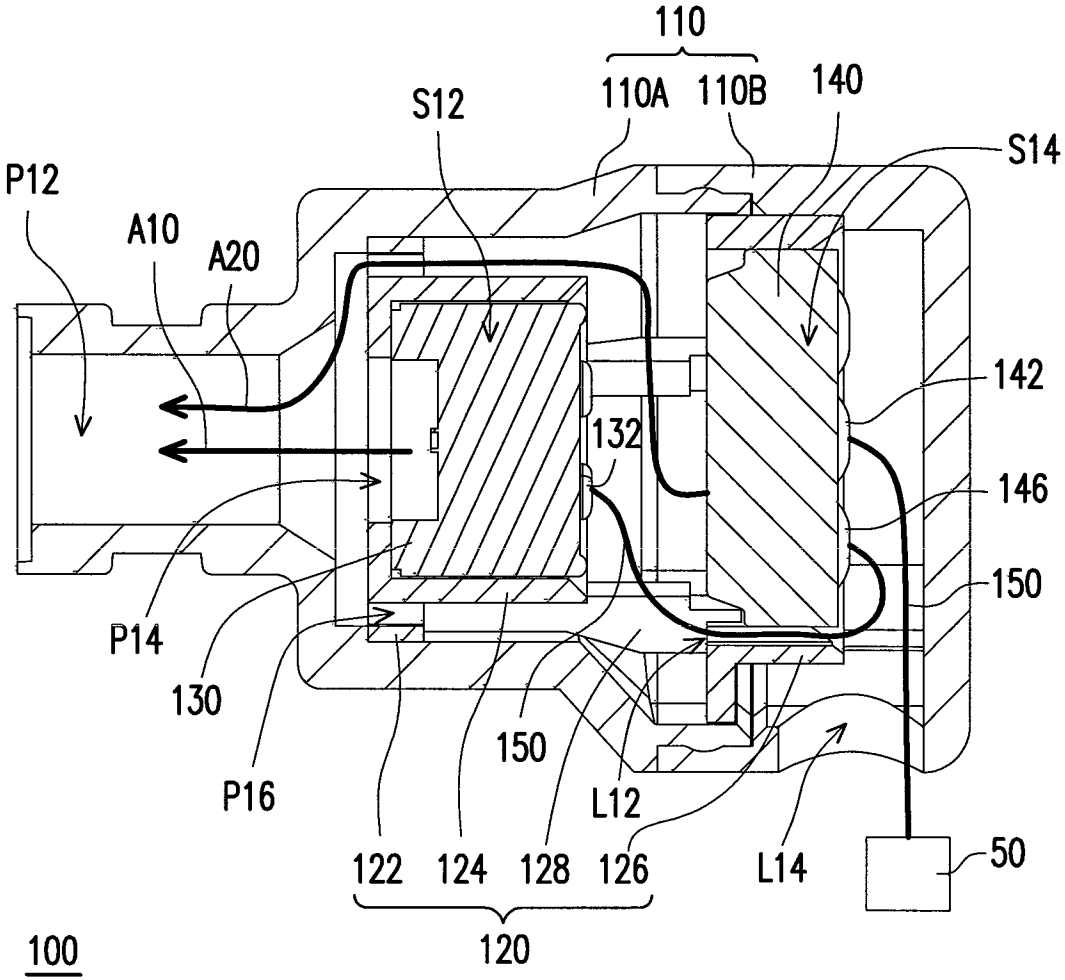
FIG. 3 is a partial cut view of the earphone of FIG. 1.

FIG. 3 is a partial cut view of the earphone of FIG. 1. Referring to FIG. 3, the first speaker unit 130 is disposed in the first accommodating space S12. The second speaker unit 140 is disposed in the second accommodating space S14.

In view of the above, the first speaker unit 130 and the second speaker unit 140 are disposed inside the earphone 100 of the present embodiment. The first speaker unit 130 and the second speaker unit 140 have different output frequencies. It means that the first speaker unit 130 and the second speaker unit 140 have different frequency response curves. Therefore, the entire output audio frequency of the earphone 100 of the present embodiment will be a summation of the output audio frequencies of the first speaker unit 130 and the second speaker unit 140, and a broader range of the output audio frequency and a smooth frequency response curve can be obtained more easier. Thereby, a better sound quality can be provided to the users by the earphone 100 of the present embodiment. Moreover, in the earphone 100 of the present embodiment, the first speaker unit 130 and the second speaker unit 140 are fixed by the bracket 120, and fixed relative positions of the bracket 120 and the housing 100 can be maintained easily. Therefore, space for better audio output of the first speaker unit 130 and the second speaker unit 140 can be surely kept for providing better sound quality to the users and decreasing the difficulty of assembling.

The housing 110 includes a front housing 110A and a rear housing 110B. The front housing 110A is assembled to the rear housing 110B. For example, while assembling the earphone 100 of the present embodiment, the first speaker unit 130 is disposed inside the first accommodating space S12 of the bracket 120. Thereafter, the second speaker unit 140 is disposed in the second accommodating space S14 of the bracket 120. Afterward, the bracket 120, the first speaker unit 130 and the second speaker unit 140 are simultaneously disposed into the front housing 110A. Finally, the front housing 110A is assembled to the rear housing 110B for forming the earphone 100 of the present embodiment. Because the first speaker unit 130 and the second speaker unit 140 are fixed by the bracket 120, additional process for positioning the first speaker unit 130 and the second speaker unit 140 after the first speaker unit 130 and the second speaker unit 140 are disposed into the housing 110 is needless, so that the assembling period and the cost can be decreased. The assembling between the front housing 110A and the rear housing 110B can be achieved by simple wedging structure or other solutions.

The housing 110 of the present embodiment has a main audio-output path P12. Sound provided by the first speaker unit 130 and the second speaker unit 140 are both transmitted out via the main audio-output path P12. Meanwhile, the bracket 120 of the present embodiment may further have a central hole located at the central of the front of the bracket 120. The first accommodating space S12 is connected to the main audio-output path P12 via the central hole P14. Moreover, the bracket 120 of the present embodiment may further have a plurality of surrounding holes located at the periphery of the front of the bracket 120. The second accommodating space S14 is connected to the main audio-output path P12 via the surrounding holes P16. In other words, sound provided by the first speaker unit 130 of the present embodiment is transmitted to the main audio-output path P12 via the central hole P14, and sound provided by the second speaker unit 140 of the present embodiment is transmitted to the main audio-output path P12 via the surrounding holes P16. By arranging two independent transmitting paths before the main audio-output path P12, interference between sound provided by the first speaker unit 130 and the second speaker unit 140 can be avoided, and sound quality can be maintained well.

Specifically, the bracket 120 of the present embodiment includes a front plate 122, a first tube portion 124, a second tube portion 126 and at least one connecting portion 128. The first tube portion 124 is connected to the front plate 122 and has the first accommodating space S12. The second tube portion 126 is separated from the first tube portion 124 and has a second accommodating space S14. The first tube portion 124 is between the front plate 122 and the second tube portion 126. The first tube portion 124 and the second tube portion 126 can be cylindrical, and a diameter of the first tube portion 124 is smaller than a diameter of the second tube portion 126. The first tube portion 124 and the second tube portion 126 are connected by a plurality of the connecting portions 128. The space between the first tube portion 124 and the second tube portion 126 can be used for transmitting sound provided by the second speaker unit 140 to the surrounding holes P16. The front plate 122 has the central hole P14 and the surrounding holes P16 around the central hole P14. The transmitting path of the sound provided by the first speaker unit 130 is presented by the arrow A10, and the transmitting path of the sound provided by the speaker unit 140 is presented by the arrow A20. As shown in FIG. 3, the arrows A10 and A20 are separated by the front plate 122 and the first tube portion 124 properly, so that interference between voice provided by the first speaker unit 130 and the second speaker unit 140 can be avoided, and sound quality can be maintained well.

In general, the output audio frequency of the first speaker unit 130 with bigger size is higher than the output audio frequency of the second speaker unit 140 with smaller size, but the present invention is not limited to this. Obviously, the output audio frequency of the first speaker unit 130 may overlap with the output audio frequency of the second speaker unit 140.

Referring to FIG. 2, the earphone 100 of the present embodiment further comprises a plurality of conductive wires 150. The first speaker unit 130 has two first input terminals 132 and two first output terminals 134. Each of the first input terminals 132 is electrically connected to one of the first output terminals 134, such as being electrically connected via traces on a circuit board (not labeled). The second speaker unit 140 has two second input terminals 142, two second output terminals 144 and two connection terminals 146. Each of the second input terminals 142 is electrically connected to one second output terminal 144 and one connection terminal 146, such as being electrically connected via traces on a circuit board (not labeled). Each of the second input terminals 142 is electrically connected to an external audio source 50 via one conductive wire 150. Each of the second output terminals 144 is electrically connected to a second coil 148 of the second speaker unit 140 via one conductive wire 150. Each of the connection terminals 140 is electrically connected to one first input terminal 132 via one conductive wire 150. Each of the first output terminals 134 is electrically connected to a first coil 138 of the first speaker unit 130 via one conductive wire 150. The first coil 138 and the second coil 148 are presented by dash lines. In the present embodiment, the first speaker unit 130 and the second speaker unit 140 are connected by the conductive wires 150 first, and than the second speaker unit 140 is connected to the external audio source 50 via the conductive wires 150. Therefore, the complexity of wires for connecting the first speaker unit 130 and the second speaker unit 140 via the conductive wires 150 respectively can be reduced, and the possibility of yield reduction caused by broken wires that produced during assembling can be decreased.

An inner wall of the second tube portion 126 may have a wire trench L12. The conductive wires 150 between the connection terminals 146 and the first input terminal 132 can pass through the wire trench. L12, as shown in FIG. 2. The housing 110 has a wire hole L14. The conductive wires 150 between the second input terminals 142 and the external audio source 50 can pass through the wire hole L14.

In view of the above, the range of the entire output audio frequency produced by two speaker units of the earphone of the present invention is broader, a uniform frequency response curve can be achieved, and thereby the sound quality of the earphone can be enhanced. Meanwhile, relative positions of two speaker units are fixed by the bracket, such that space for better audio output of the two speaker units can be surely kept, and the difficulty of assembling can be decreased for decreasing cost.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. An earphone, comprising:

a housing, having a front housing and a rear housing, wherein the front housing is assembled to the rear housing, and the front housing has a main audio-output path;

a bracket, disposed in the housing, wherein the bracket comprising:

a front plate, having a central hole and a plurality of surrounding holes around the central hole;

a first tube portion, connected to the front plate and has a first accommodating space, wherein the first accommodating space is connected to the main audio-output path via the central hole;

a second tube portion, separated from the first tube portion and has a second accommodating space, wherein the first tube portion is between the front plate and the second tube portion, and the second accommodating space is connected to the main audio-output path via the surrounding holes;

at least one connecting portion, connecting the first tube portion and the second tube portion;

a first speaker unit, disposed in the first accommodating space;

a second speaker unit, disposed in the second accommodating space; and a plurality of conductive wires, wherein the first speaker unit has two first input terminals and two first output terminals, each of the first input terminals is electrically connected to one of the first output terminals, the second speaker unit has two second input terminals, two second output terminals and two connection terminals, each of the second input terminals is electrically connected to one of the second output terminals and one of the connection terminals, each of the second input terminals is electrically connected to an external audio source via one of the conductive wires, each of the second output terminals is electrically connected to a second coil of the second speaker unit via one of the conductive wires, each of the connection terminals is electrically connected to one of the first input terminals via one of the conductive wires, each of the first output terminals is electrically connected to a first coil of the first speaker unit via one of the conductive wires.

2. The earphone of claim 1, wherein an inner wall of the second tube portion has a wire trench.

3. The earphone of claim 1, wherein the housing has a wire hole.

4. The earphone of claim 1, wherein an output audio frequency of the first speaker unit is higher than an output audio frequency of the second speaker unit.

* * * * *